United States Patent [19]

Hambling et al.

[11] 4,043,876

[45] * Aug. 23, 1977

[54] METHOD FOR ELECTROFORMING

[75] Inventors: Peter G. Hambling, Reading, England; Leslie W. Owen, deceased, late of Kingsclere, England; by Elizabeth Bertram Owen, executrix, Kingsclere; by George Mould, executor, Orpington, both of England

[73] Assignee: Xerox Corporation, Stamford, Conn.

[ * ] Notice: The portion of the term of this patent subsequent to May 25, 1993, has been disclaimed.

[21] Appl. No.: 671,240

[22] Filed: Mar. 29, 1976

Related U.S. Application Data

[63] Continuation of Ser. No. 307,699, Nov. 17, 1972, abandoned.

[51] Int. Cl.[2] ..... C25D 1/02; C25D 1/20

[52] U.S. Cl. ..... 204/9; 204/216

[58] Field of Search ..... 204/273, 216, 212, 9

[56] References Cited

U.S. PATENT DOCUMENTS

| | | | |
|---|---|---|---|
| 895,164 | 8/1908 | Cowper-Coles | 204/273 |
| 1,535,400 | 4/1925 | Crowell | 204/273 |
| 3,959,109 | 5/1976 | Hambling et al. | 204/237 |

OTHER PUBLICATIONS

Modern Electroplating, Lowenheim 2nd Ed., (1963), pp. 473–493.

*Primary Examiner*—T. M. Tufariello
*Attorney, Agent, or Firm*—James J. Ralabate; James P. O'Sullivan; Ronald L. Lyons

[57] ABSTRACT

A method of making a flexible seamless brass cylinder which comrises forming a thin continuous layer of brass of uniform thickness on the surface of a cylindrically shaped vertical rotating mandrel by electrolitic deposition in an electrolic bath containing at least one brass anode. Apparatus for carrying out the electroforming process is also disclosed.

3 Claims, 2 Drawing Figures

METHOD FOR ELECTROFORMING

CROSS-REFERENCE TO RELATED APPLICATIONS

This application is a continuation of copending application Ser. No. 307,699, filed Nov. 17, 1972, now abandoned.

BACKGROUND OF THE INVENTION

This invention relates to electroforming, and is particularly, although not exclusively, concerned with a method and apparatus for electroforming brass cylinders.

Electroforming is a well known process in which a former or mandrel is electroplated with a metal by using the former as a cathode, to form a metal layer of the desired shape, after which the former is removed. While many metals are electroplated for decorative, protective, and other uses, only a few find use for electroforming, partly because only a few of the processes available are satisfactory for producing thick or heavy coatings of satisfactory physical and mechanical properties. Most electroforming is carried out with nickel or copper, which fulfill most of the engineering requirements. Very little electroforming has been carried out using alloys.

Electroplating, on the other hand, has been carried out using alloys such as brass, but there is no information to suggest that coatings of acceptable quality can be obtained at thicknesses in excess of about 0.0005 inches (12.5 microns). Even if sound thicker coatings of brass were possible, for example, 0.0005 inches (125 microns) thick, the rates of deposition hitherto achieved are so slow that an inordinate amount of time would be required to achieve substantial thickness. The rate of deposition obtained in a conventional brass plating bath is slow since only relatively small current densities are used. This is because of the low cathode efficiency, that is to say the low efficiency with which metal is deposited. Increasing the current density further in an attempt to increase the deposition rate results in even lower cathode efficiencies. A further, serious, factor to increasing the current density is that the brass anodes employed in the plating bath polarize, and eventually become passive. The composition of the bath may then rapidly become out of balance.

The quality of the metal deposit often deteriorates as thickness increases, and one method of improving the quality of the deposit is to employ periodic reversal of the plating current. In addition, in order to ensure unifom deposition around an article during the electroforming thereof, the article may be rotated within the bath. Typically, in such a process, a current density of 3–5 amps/dm$^2$ has been used. In these circumstances, a time of about 2 hours is necessary to produce a coating of about 0.005 inches (125 microns). This time is rather long for a commercial process.

OBJECTS OF THE INVENTION

It is an object of the present invention to provide a method and apparatus for electroforming in which many of the disadvantages of earlier methods are overcome.

It is another object of this invention to provide an improved method of electroforming brass cylinders.

SUMMARY OF THE INVENTION

According to one aspect of the present invention there is provided a method of electroforming comprising electroforming a coating of metal onto a former in a plating bath, the former being connected as the cathode, and rotating the former during electroplating such that its surface has a linear velocity through the bath of at least 30 cm per second.

According to another aspect of the present invention, there is provided an apparatus for electroforming, comprising an electroplating bath having therein an anode and a cathode, and means to pass a plating current between said anode and cathode, said cathode being a former onto which a metal coating is electroplated, and means to rotate the cathode such that its surface has a linear velocity through the plating bath of at least 30 cm per second.

By selecting a sufficiently rapid rate of rotation of the cathode, the cathode efficiency at a given current density may be maintained substantially at the level obtaining in conventional brass electroplating. Furthermore, the anodes show considerably less tendency to become polarized.

BRIEF DESCRIPTION OF THE DRAWINGS

A method of electroforming will now be described, by way of example, using the apparatus shown in the accompanying drawings, in which.

DETAILED DESCRIPTION OF THE DRAWINGS

Figure 1:
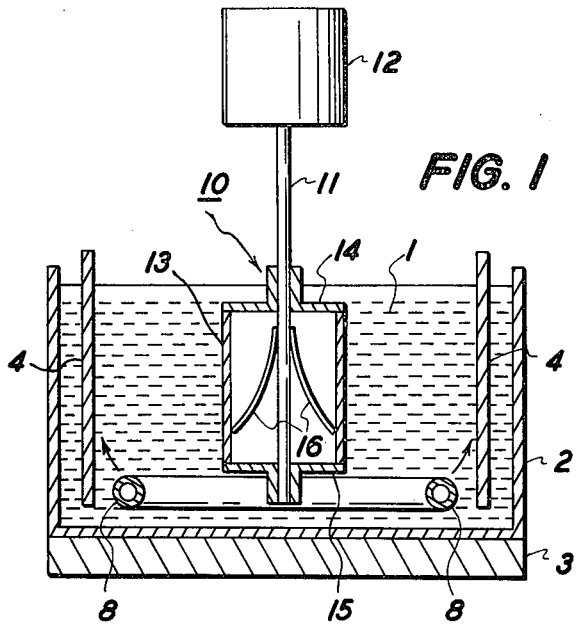
FIG. 1 is a cross-section view of one embodiment of the apparatus of the present invention.
Figure 2:
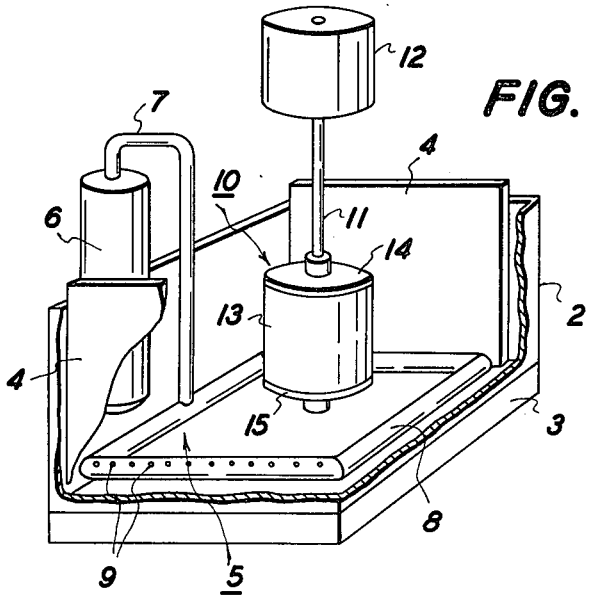
FIG. 2 is a perspective view of one embodiment of apparatus of the invention, with parts cut away.

Referring to FIGS. 1 and 2 of the drawings, a plating bath comprises an electrolyte 1 which is contained in a tank 2. The bath is heated by means, for example, of an external heater 3, or by internal heaters (not shown). If necessary, thermostats may be employed to maintain the bath at a constant temperature. Rigidly supported in the tank 2 near two opposed walls thereof, are two brass anode plates 4. These are both connected to one terminal of a suitable electrical supply (not shown). Also rigidly supported within the tank 2 is a circulation system 5 (FIG. 2) for the electrolyte 1. The circulation system 5 includes a filter element and circulator 6, which draws in electrolyte from the bath at its lower end, and supplies it through pipe 7 to a feed pipe 8. The feed pipe 8 is formed into a closed rectangular loop, and feeds electrolyte into the bath through a plurality of apertures 9 which direct the electrolyte towards the inward facing surfaces of the anode plates 4, as shown by arrows in FIG. 1. In this way, rapid movement of the electrolyte over the anode plates 4 in ensured.

A cathode assembly 10, which is located midway between the anode plates 4, includes a drive rod 11 which is connected to the other terminal of the electrical supply, by way of a slip ring, or directly through a bearing, and which may be rotated by a motor 12. At its end within the bath, the drive rod 11 carries a stainless steel cylinder 13 which acts as a former for the electroforming process. The cylinder 13 is supported between disc-shaped PTFE end plates 14 and 15, and electrical connection between the rod 11 and the cylinder 13 is established by conductive metal spring members 16 which are secured at their upper ends to the rod 11.

The electrical supply may incorporate a device for providing periodic reversal of the current, and as deposition of a brass coating takes place on the cylinder 13, the cathode assembly is rotated by the motor 12 such that the surface of cylinder 13 moves through the bath at a speed of at least one foot (30 cm) per second.

OPERATION OF THE APPARATUS

Using the apparatus of this invention, electroforms having thickness of about 0.005 inches (125 microns), and of reasonable quality and appearance, are obtainable. With increasing current and speeds or rotation, the quality of the best electroforms is maintained. At a current density of about 13 amps/dm$^2$ and a speed of rotation providing a linear velocity at the cathode surface of about 13 feet (395 cm) per second, a plating rate of approximately 0.0005 inches (125 microns) in 20 minutes is achieved. Using a cylinder 13 having a diameter of 3½ inches (8.9 cm) the rotational speed of the cathode assembly is 850 RPM.

During a typical operation of the process, the bath analysis and operating conditions may be within the following ranges:

| | |
|---|---|
| Bath Analysis | |
| Cu metal | 40 - 25 gm/liter |
| Zn metal | 2.4 - 3.4 gm/liter |
| Sodium carbonate | 40 - 75 gm/liter |
| Free cyanide | 10 - 4.4 gm/liter |
| Free OH | 10 - 1.5 gm/liter |
| pH | about 12. |
| Operating Conditions | |
| Cathode current density | 10 - 13 amps/dm$^2$ |
| Temperature | 80 - 82° C |
| Cathode rotation | 10.6 - 13 (linear) feet per second (323 - 395 (linear) cm/sec) |

During an actual operation of the process, the bath analysis and operating conditions were as follows:

| | |
|---|---|
| Bath Analysis | |
| Cu metal | 30 gm/liter |
| Zn metal | 3.3 gm/liter |
| Cu/Zn ratio | 9/1 |
| Sodium Carbonate | 73 gm/liter |
| Free Cyanide | 4.4 gm/liter (as NaCN) |
| Free OH | 1.5 gm/liter (as NaOH) |
| pH | about 12. |
| Operating Conditions | |
| Cathode Current Density | 10 amps/dm$^2$ |
| Temperature | 82° C |
| Cathode Rotation | 10.6 (linear) feet (323 cm) per second. |

Using a bath within the above ranges, and within the above operating conditions, a plating time of about 20 minutes results in an electroformed layer some 0.003 to 0.005 inches (75 to 125 microns) thick. Thus, by using the present invention, it is possible to obtain relatively thick electroforms in brass, much more rapidly than previously possible, with such electroforms exhibiting reasonably good quality.

The electroforms produced by the method of the present invention are particularly useful as conductive, endless flexible substrates for use as the photoreceptor member in xerographic copying machines. These electroformed belts are later coated with a photoconductive layer when used for such applications. An especially desirable feature of such belts is that they are seamless and therefore capable of exhibiting uniform properties with respect to electrical and mechanical requirements of their intended use.

Although specific components and proportions have been stated in the above description of the preferred embodiments of this invention, other suitable materials and procedures such as those listed above may be used with similar results. In addition, other materials and changes may be utilized which symergize, enhance, or otherwise modify the above techniques.

Other modifications and ramifications of the present invention would appear to those skilled in the art upon reading the disclosure. These are also intended to be within the scope of this invention.

What is claimed is:

1. A method of electroforming which consists essentially of:

a. providing an apparatus for electroforming which consists essentially of:
   1. a tank suitable for containing an electroplating bath;
   2. an anode and a cathode located in said tank in a position to allow a plating current to pass between said anode and cathode, said cathode being a former onto which a metal coating is electroformed, said cathode being centralized in said tank and located further from said tank walls than said anode, said anode located adjacent said tank walls;
   3. means for filtering and circulating said electroplating bath connected to said tank;
   4. a closed loop feeding pipe located in said tank between said anode and said cathode for feeding an electrolyte into said tank, said closed loop feeding pipe having a plurality of apertures which are located such that the flow of said electrolyte is directed toward an inward facing surface of said anode surface;
   5. means for passing a plating current between said anode and cathode; and
   6. means to rotate said cathode such that its surface has a linear viscosity through said electroplating bath at least about 30 cm. per second;

b. providing said electroplating bath containing a source of copper and zinc having the following composition:

| | |
|---|---|
| Cu metal | 40 - 25 gm/liter |
| Zn metal | 2.4 - 3.4 gm/liter |
| Sodium Carbonate | 40 - 4.4 gm/liter |
| Free OH | 10 - 1.5 gm/liter |
| pH | about 12 |

c. said former cathode having a current density in the range of about 10–13 amps/dm$^2$; and d. rotating the former during the electroplating such that its surface has a linear velocity through the bath of about 323–395 cm. per second.

2. The method of claim 1 wherein the polarity of the plating current is periodically reversed.

3. The method of claim 1 wherein the bath temperature is maintained in the range of about 80° to 82° C.

* * * * *

UNITED STATES PATENT AND TRADEMARK OFFICE

CERTIFICATE OF CORRECTION

PATENT NO. : 4,043,976

DATED : August 23, 1977

INVENTOR(S) : TOSHIO YOSHIKAWA et al

It is certified that error appears in the above-identified patent and that said Letters Patent are hereby corrected as shown below:

Title page, at [75]: replace "Lomitado Nagamori" with --- Tomitada Nagamori ---.

Column 1, line 67: replace "oxalobis(benzyldenehydrazide)" with --- oxalobis(benzylidenehydrazide) ---.

Column 8, Table 6: delete "Example No. 35" (second occurrence).

Signed and Sealed this

*Twenty-fourth* Day of *July 1979*

[SEAL]

*Attest:*

*Attesting Officer*

LUTRELLE F. PARKER

*Acting Commissioner of Patents and Trademarks*